US006722133B2

(12) United States Patent
Inoue et al.

(10) Patent No.: US 6,722,133 B2
(45) Date of Patent: Apr. 20, 2004

(54) GAS-TURBINE ENGINE COMBUSTOR

(75) Inventors: Tsutomu Inoue, Wako (JP); Atsushi Yamazaki, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 44 days.

(21) Appl. No.: 10/228,109

(22) Filed: Aug. 27, 2002

(65) Prior Publication Data

US 2004/0011042 A1 Jan. 22, 2004

(30) Foreign Application Priority Data

Aug. 28, 2001 (JP) ..... 2001-258198

(51) Int. Cl.[7] ..... F02C 3/00; F02C 7/22
(52) U.S. Cl. ..... 60/737
(58) Field of Search ..... 60/737, 747, 748

(56) References Cited

U.S. PATENT DOCUMENTS 4,455,840 A * 6/1984 Matt et al. ..... 60/737
4,589,260 A * 5/1986 Krockow ..... 60/737
5,404,711 A * 4/1995 Rajput ..... 60/737
5,765,363 A * 6/1998 Mowill ..... 60/773
5,839,283 A * 11/1998 Dobbeling ..... 60/737
5,855,112 A * 1/1999 Bannai et al. ..... 60/39.511
6,176,087 B1 * 1/2001 Snyder et al. ..... 60/737
6,189,314 B1 * 2/2001 Yamamoto et al. ..... 60/737

FOREIGN PATENT DOCUMENTS

JP 1-163426 6/1989
JP 4-43220 2/1992
JP 7-248118 9/1995

* cited by examiner

*Primary Examiner*—Ted Kim
(74) *Attorney, Agent, or Firm*—Squire, Sanders & Dempsey L.L.P.

(57) ABSTRACT

A gas-turbine engine combustor having a plurality of venturi mixers, each includes an air inlet connecting to an air supply path, a fuel inlet connecting to a supply source of gaseous fuel, and an air-fuel mixture generating passage connecting to the air inlet and the fuel inlet and merges with an air-fuel mixture generating section to produce the air-fuel mixture and a nozzle opened into the combustion chamber at an end of the air-fuel mixture generating passage. In the combustor, the venturi mixers are arranged radially around a center axis of the combustion chamber, the air-fuel mixture generating passage is provided with a throttle section of diminishing diameter, and the nozzle is shifted circumferentially about the center axis relative to the air inlet such that the air-fuel mixture generating passage is deflected in a circumferential direction between the throttle sections and the nozzle, thereby expanding the premixed combustion range to realize further reducing of emissions, without producing backfire or self-ignition.

6 Claims, 9 Drawing Sheets

GAS-TURBINE ENGINE COMBUSTOR

BACKGROUND OF THE INVENTION

1. Field of the Invention

This invention relates to a gas-turbine engine combustor.

2. Description of the Related Art

As taught for example by Japanese Laid-open Patent Application No. Hei 4(1992)-43220, one known type of gas-turbine engine combustor, more specifically premixed combustor, uses fuel injection nozzles distributed before and after the swirl to premix fuel and air by swirling.

Another type, such as that taught by Japanese Laid-Open Patent Application No. Hei 7(1995)-248118, uses fuel injection nozzles provided at the inlet portion of multiple premixing pipes to premix fuel and air without swirling or has premixing pipes disposed in the combustion chamber so as to produce a swirling flow.

Still another type, such as taught by Japanese Laid-Open Patent Application No. Hei 1(1989)-163426 (corresponding to U.S. Pat. No. 4,845,952), uses multiple venturi mixers (a multi-venturi mixer) to supply a homogeneous or uniform premixing to the combustion chamber and reduces NOx by passing the combusted gas through a downstream catalyst bed.

The technology taught by Publication No. 4(1992)-43220 is disadvantageous in that it produces a circulating and/or reverse flow and, moreover, is readily affected by the resulting wake to self-ignite or backfire.

In the case of the technology taught by Publication No. 7(1995)-248118, when the premixing pipes are long, self-ignition is apt to occur and it is difficult to obtain a homogeneous or uniform air-fuel mixture. The technology taught by Publication No. 1(1989)-163426 requires installation of a swirler downstream of the mixer in the case of lean premixed combustion, but the installed swirler increases the likelihood of backfire and self-ignition.

Thus, these prior art technologies cannot easily generate a homogeneous or uniform air-fuel premixing (i.e., a homogeneous fuel distribution) without producing backfire and/or self-ignition and are also incapable of readily achieving stable lean premixed combustion. They therefore leave much to be desired from the aspect of further decreasing emissions by expanding the premixed combustion range.

SUMMARY OF THE INVENTION

An object of the present invention is therefore to overcome the foregoing shortcomings by providing a gas-turbine engine combustor that does not produce backfire or self-ignition, that produces a highly homogeneous air-fuel premixing, and achieves stable lean premixed combustion, thereby expanding the premixed combustion range to realize further reducing of emissions.

The present invention achieves the foregoing object by providing a gas-turbine engine combustor having a plurality of venturi mixers, each connected to an air supply path that passes air compressed by a compressor and to a supply source of gaseous fuel, which mix the air and the gaseous fuel to produce an air-fuel mixture and supply the air-fuel mixture to a combustion chamber for combustion such that produced combustion gas rotates a turbine that outputs its rotation through an output shaft, while driving the compressor by the rotation; including: an air inlet formed in each of the venturi mixers and connecting to the air supply path; a fuel inlet formed in each of the venturi mixers and connecting to the supply source of gaseous fuel; an air-fuel mixture generating passage, formed in each of the venturi mixtures, which connects to the air inlet and the fuel inlet and merges with an air-fuel mixture generating section to produce the air-fuel mixture; and a nozzle or jet which opens into the combustion chamber at an end of the air-fuel mixture generating passage; wherein the venturi mixers are arranged radially around a center axis of the combustion chamber; the air-fuel mixture generating passage formed in each of the venturi mixers is provided with a throttle section of diminishing diameter; and the nozzle or jet is shifted circumferentially about the center axis relative to the air inlet such that the air-fuel mixture generating passage is deflected in a circumferential direction between the throttle sections and the nozzle or jet.

BRIEF DESCRIPTION OF THE DRAWINGS

The objects and advantages of the invention will be made with reference to the following description and drawings, in which.

DETAILED DESCRIPTION OF THE PREFERRED EMBODIMENT

A gas-turbine engine combustor according to an embodiment of the present invention will now be explained with reference to the attached drawings.

Figure 1:
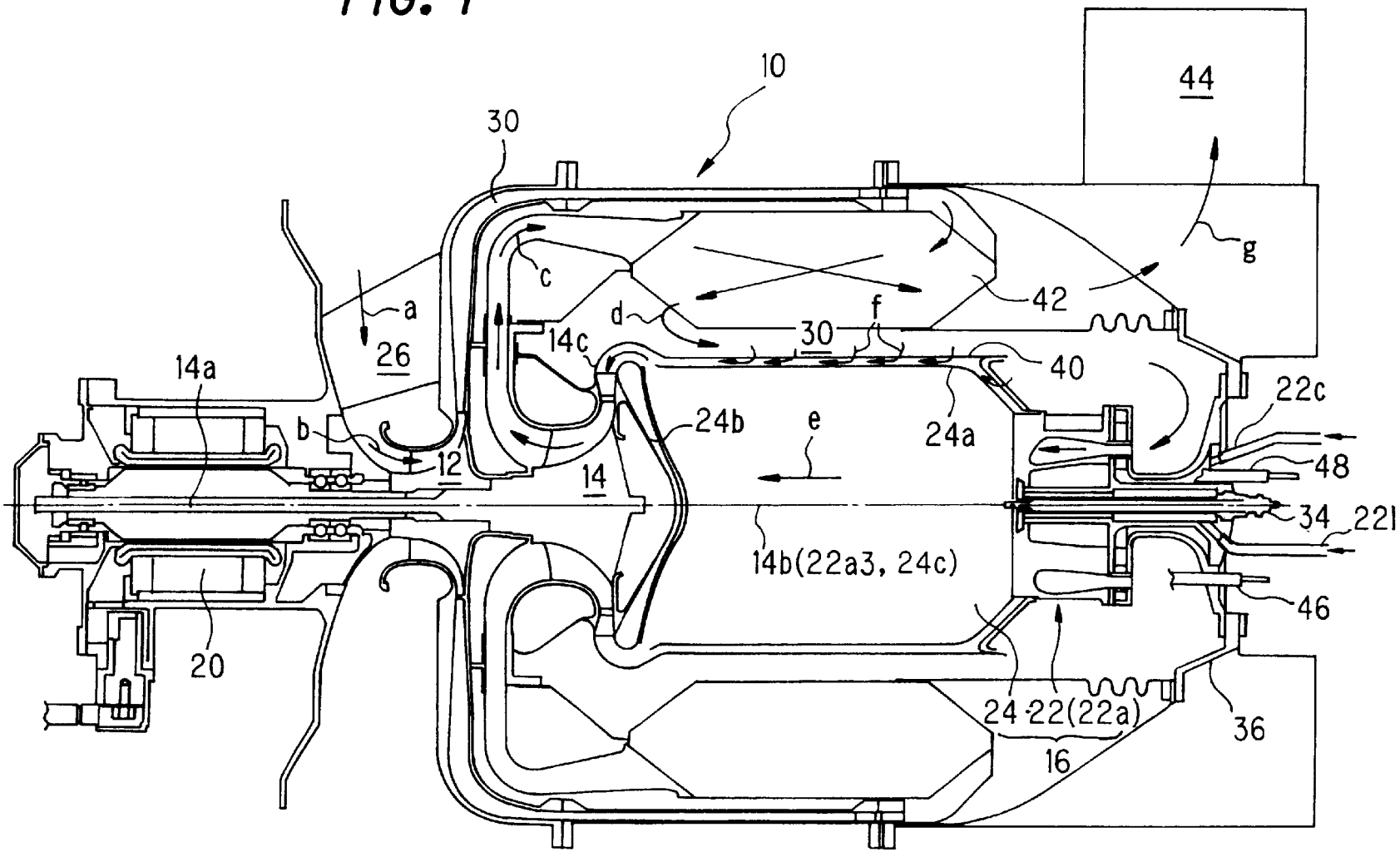
FIG. 1 is a schematic view showing a gas-turbine combustor together with the whole of the gas-turbine engine according to an embodiment of the invention.

FIG. 1 is a schematic view showing the combustor together with the whole of the gas-turbine engine.

The gas-turbine engine is designated by reference numeral 10 in FIG. 1. The gas-turbine engine 10 is equipped with a compressor 12, a turbine 14 and a combustor 16. The compressor 12 is driven by rotation of the turbine 14 transmitted through an output shaft (turbine shaft ) 14*a* of the turbine 14 that connects the two.

The output shaft 14*a* of the turbine 14 is also connected to a generator 20. The generator 20 is driven by the turbine 14 to generate around 100 kW of electricity. Electrical equipments (not shown) is connected to the generator 20 as a load. The gas-turbine engine 10 is a small unit for stationary installation in an independent power plant, i.e., the so-called micro turbine power generation system.

The combustor 16 includes venturi mixers 22 and a combustion chamber 24 that are connected through an airtight joint. As illustrated, the venturi mixers 22 are formed in a mixer unit 22*a*. The mixer unit 22*a* is located on a center axis 24*c* (coincident with the center axis 14*b* of the turbine output shaft) of the combustion chamber 24.

In the mixer unit 22*a*, each venturi mixer 22 is connected to an outwardly opening air intake port 26 for sucking in fresh air, is connected to an air supply path 30 for passing air compressed by the compressor 12, and is connected to a gaseous fuel supply source (not shown). It mixes the air and the gaseous fuel to produce an air-fuel mixture, and supplies the air-fuel mixture to the combustion chamber 24 for combustion. Natural gas or other such fuel gas is used as the gaseous fuel.

Figure 2:
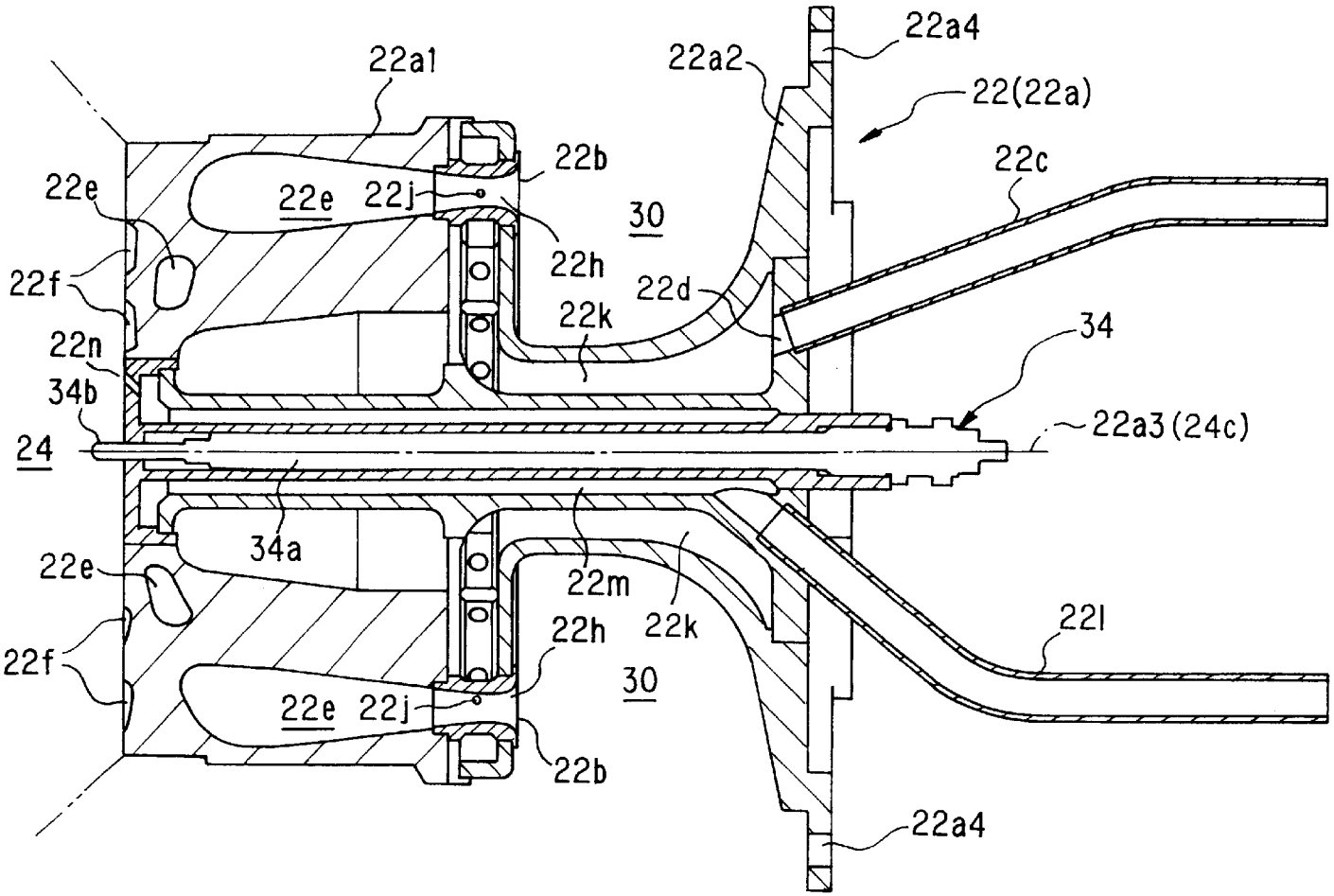
FIG. 2 is a sectional view showing structural details of a mixer unit in which venturi mixers are formed illustrated in FIG. 1.
Figure 3:
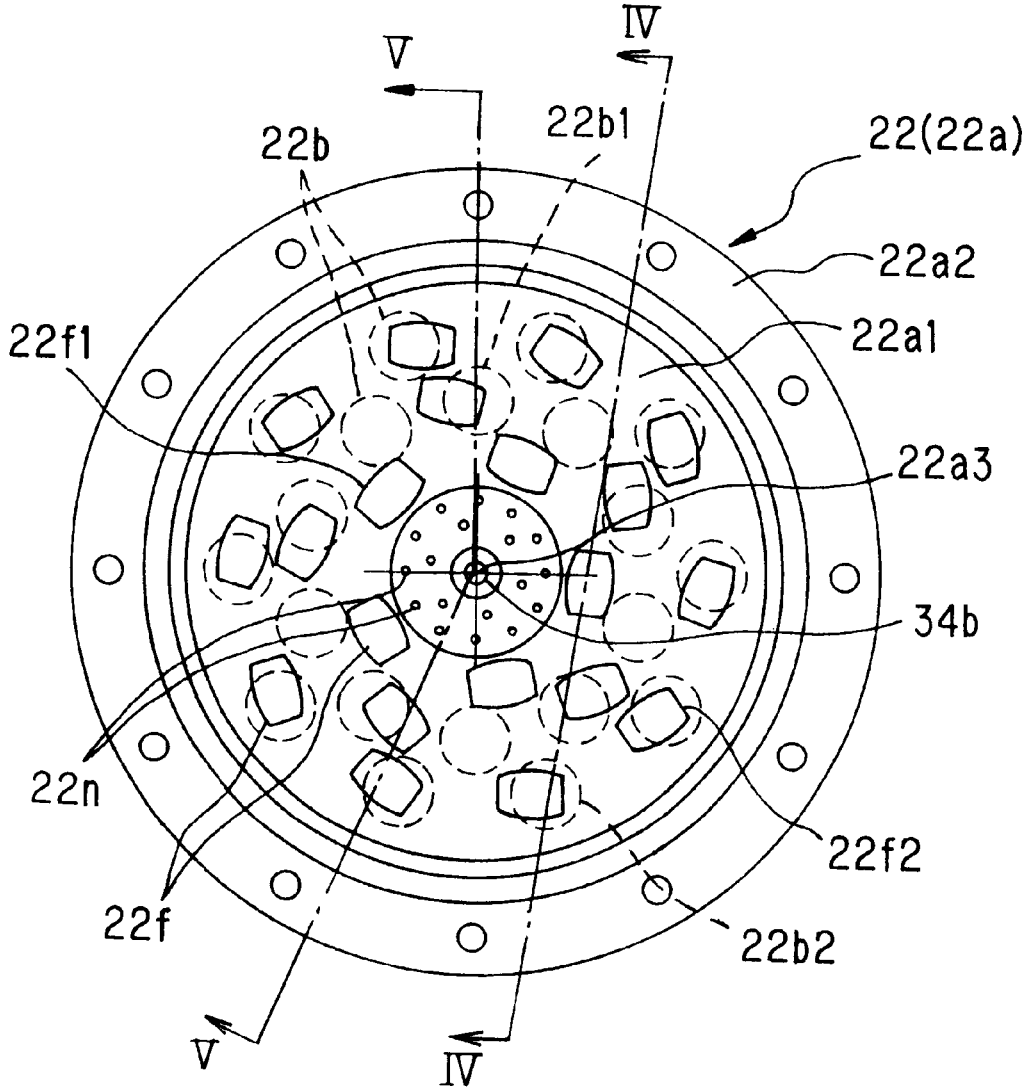
FIG. 3 is a front view of the mixer units seen from the side of a combustion chamber illustrated in FIG. 1.
Figure 4:
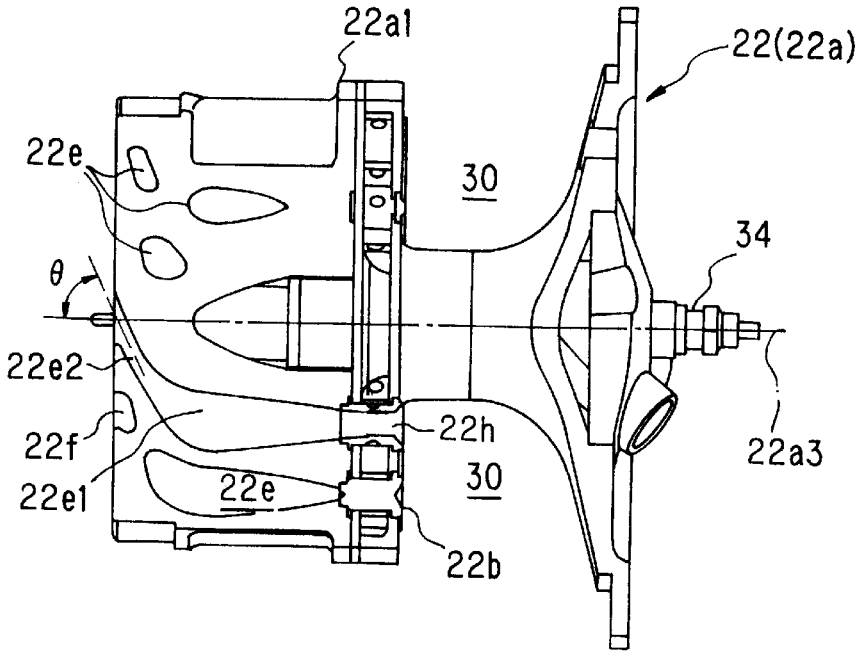
FIG. 4 is a sectional view taken along line IV—IV in FIG. 3.
Figure 5:
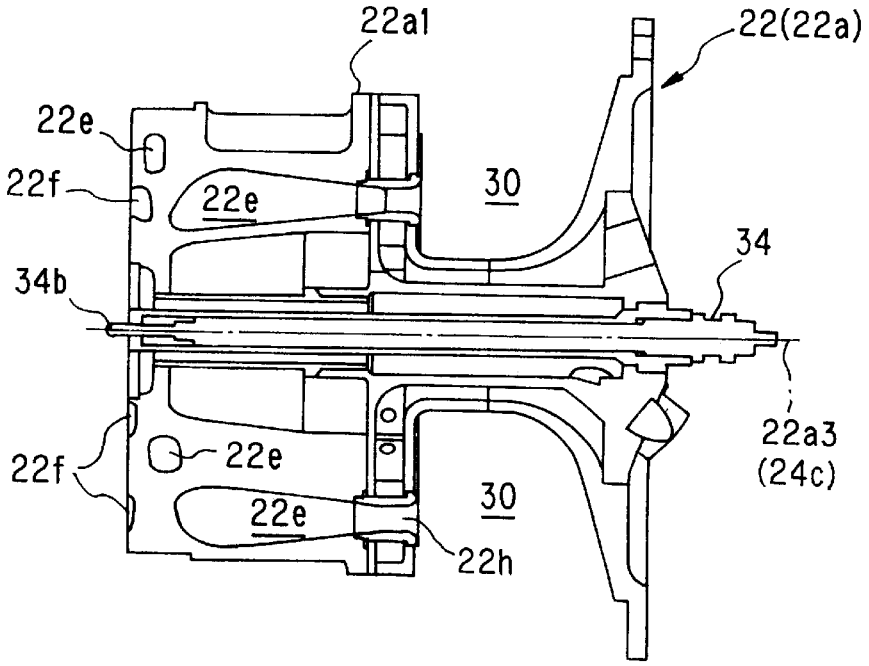
FIG. 5 is a sectional view taken along line V—V in FIG. 3.

FIG. 2 is a sectional view showing structural details of the mixer unit 22*a* in which the venturi mixers 22 are formed, FIG. 3 is a front view of the mixer unit 22*a* as seen from the combustion chamber side, FIG. 4 is a sectional view taken along line IV—IV in FIG. 3, and FIG. 5 is a sectional view taken along line V—V in FIG. 3.

As illustrated, the mixer unit 22*a* comprises a main body 22*a*1 on the combustion chamber side, a flange member 22*a*2 attached thereto, and multiple venturi mixers (constituting a multi-venturi mixer) 22 formed inside these two members.

The structure of the venturi mixers 22 will now be explained in detail. The multiple venturi mixers 22 (more precisely, 20 thereof) are configured to constitute a multi-venturi mixer. As best shown in FIG. 3, 10 of the venturi mixers 22 are arrayed radially at regular spacing around the center axis 22*a*3 of the mixer unit 22*a* (coincident with the center axis 14*b* of the output shaft 14*a* of the turbine 14), and the remaining 10 are similarly arrayed at regular spacing radially outward thereof.

Each of the twenty venturi mixers 22 comprises an air inlet 22*b* in communication with the air supply path 30, a fuel inlet 22*d* connected to the gaseous fuel supply source through a fuel line 22*c*, an air-fuel mixture generating passage 22*e* in communication with the air inlet 22*b* and the fuel inlet 22*d* and merging with an air-fuel mixture generating section to produce an air-fuel mixture, and a nozzle or jet 22*f* that opens into the combustion chamber 24 at the end of the air-fuel mixture generating passage 22*e*.

The air-fuel mixture generating section comprises a throat portion 22*h* in communication with the air inlet 22*b* and having a circular cross-section of diminishing diameter (explained later) and a fuel passage 22*k* in communication with the fuel inlet 22*d* and merging with nozzles or jets 22*j* formed in the throat portion 22*h* to communicate with the air-fuel mixture generating passage 22*e*.

Figure 6:
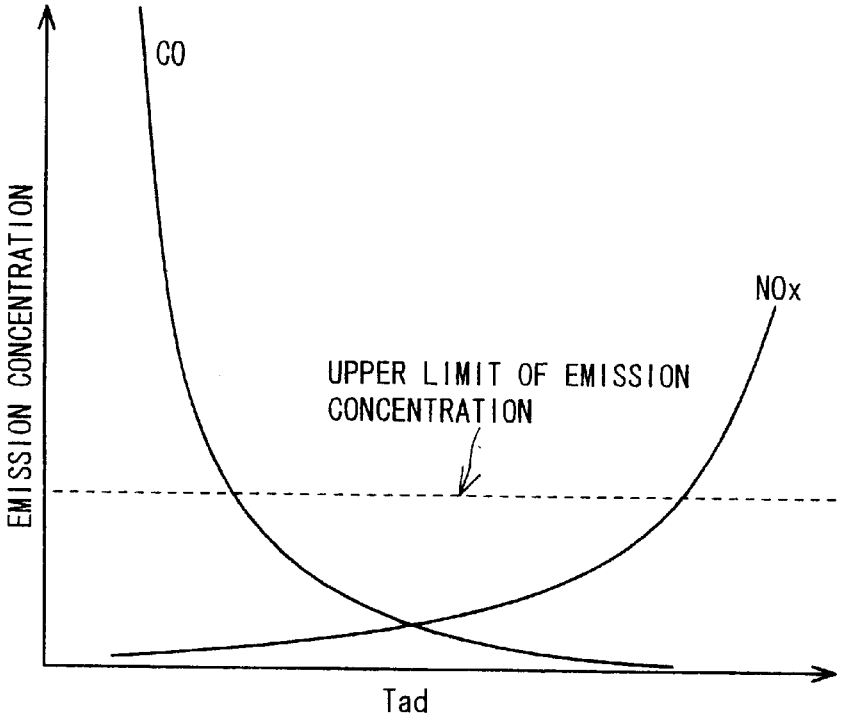
FIG. 6 is a graph showing how CO and NOx emission concentrations (exhaust concentrations) vary with combustion temperature, more specifically, adiabatic flame temperature Tad.

The illustrated gas-turbine engine 10 uses a gaseous fuel (natural gas) and the foregoing description relates to the case of supplying an air-fuel mixture for premixed combustion. FIG. 6 is a graph showing how CO and NOx emission concentrations (exhaust concentrations) vary with combustion temperature, more specifically, adiabatic flame temperature Tad (temperature when the air-fuel mixture is burned under adiabatic condition).

In order to achieve low emissions, it is preferable to reduce the CO and NOx emission concentrations to the lowest possible level below the indicated upper limit of emission concentration. In a gas-turbine engine of this type, combustion mode is broadly divided into diffusive combustion and premixed combustion. Although premixed combustion is superior to diffusive combustion in the point of emission performance because the combustion temperature is lower, it is more susceptible to flameout during idling and other such operating conditions.

Figure 7:
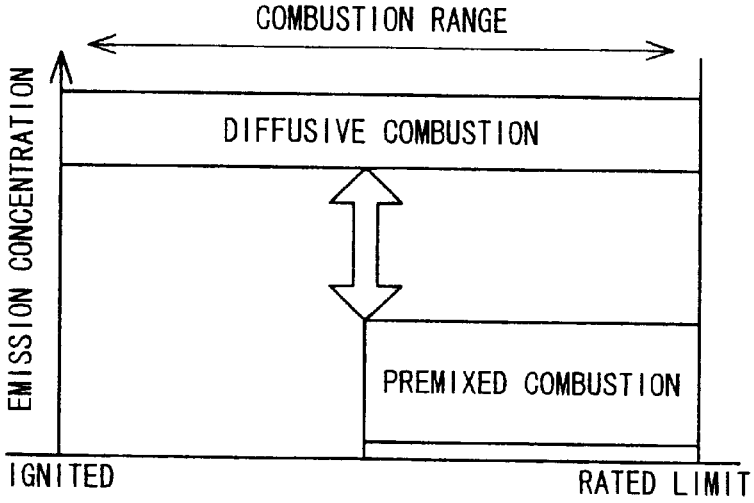
FIG. 7 is an explanatory view showing a possible range of diffusive combustion and premixed combustion in the gas-turbine engine illustrated in FIG. 1.

On the other hand, diffusive combustion can achieve stable combustion but the presence of scattered high-temperature sites increases NOx emission concentration. Thus, as shown in FIG. 7, diffusive combustion is always possible within the combustion range but premixed combustion is possible only within a limited range. The venturi mixers 22 are therefore structured to enable both combustion modes and one of the two combustion modes is selected in light of the adiabatic flame temperature Tad and the operating condition.

The structure for diffusive combustion will now be explained with reference to FIG. 2. An ignition plug 34 for igniting the air-fuel mixture is installed on the center axis 22*a*3 of the mixer unit 22*a* (coincident with the center axis 14*b* of the output shaft 14*a* of the turbine 14 and the center axis 24*c* of the combustion chamber 24), and a second fuel passage 22*m* for diffusive combustion is formed around the body 34*a* of the ignition plug 34 to communicate with the gaseous fuel supply source through a second fuel line 221 and extend straight along the ignition plug 34.

The ignition plug 34 is of the glow type. Its tip, located in the combustion chamber 24, is formed with a heating element 34*b*. When the ignition plug (glow plug) 34 is supplied with electric current from a voltage source (not shown), the heating element 34*b* at the tip produces heat at a temperature of 1200–1300° C. that ignites the air-fuel mixture in the combustion chamber 24.

A plurality of second nozzles or jets 22*n* communicating with the second fuel passage 22*m* are provided at the end of the second fuel passage 22*m* to surround the heating element 34*b* of the ignition plug 34. More exactly, as shown in FIG. 3, groups of 6 and 12 second nozzles or jets 22*n* are formed at prescribed spacing on two concentric circles so as to be radially arrayed to lie adjacent to and surround the heating element 34*b*. In other words, they are located on two (multiple) circles of different radius. In the interest of simplifying the drawing, only one second nozzle or jet 22*n* is shown in FIG. 2.

As shown in FIG. 2, the heating element 34*b* of the ignition plug 34 is located on the center axis 22*a*3 of the mixer unit 22*a* (the center axis 24*c* of the combustion chamber 24), the 18 second nozzles or jets 22*n* for diffusive combustion are arrayed around the heating element 34*b*, and the 20 nozzles or jets 22*f* for premixed combustion are arrayed around the second nozzles or jets 22*n*.

In the illustrated structure, premixed combustion fuel is supplied to the fuel inlet 22*d* communicating with the gaseous fuel supply source through the fuel line 22*c*, and diffusive combustion fuel is supplied to the second fuel passage 22*m* communicating with the gaseous fuel supply source through the second fuel line 221.

Although the premixed combustion fuel and the diffusive combustion fuel are the same kind of gaseous fuel, they are supplied through separately provided supply systems because premixed combustion requires generation of a homogeneous or uniform air-fuel mixture before injection into the combustion chamber 24 and also because of the need to switch between premixed combustion and diffusive combustion.

When supply of premixed combustion fuel is turned off and supply of diffusive combustion fuel is turned on, by opening and closing valves (not shown), for instance, diffusive combustion fuel passes through the second fuel passage 22*m* to be injected into the combustion chamber 24 from the second nozzles or jets 22*n*. At this time, air supplied from the air inlets 22*b*, passes through the air-fuel mixture generating passages 22*e*, is injected or jetted into the combustion chamber 24 from the nozzles or jets 22*f*, mixes with fuel in the combustion chamber 24 to form an air-fuel mixture, and the air-fuel mixture is ignited to produce diffusive combustion.

On the other hand, when the supply of diffusive combustion fuel is turned off and the supply of premixed combustion fuel is turned on, the premixed combustion fuel merges with air in the air-fuel mixture generating sections to generate an air-fuel mixture, the air-fuel mixture passes through the air-fuel mixture generating passages 22*e* to be injected from the nozzles or jets 22*f* into the combustion chamber 24 where it is ignited to produce premixed combustion.

The air-fuel mixture generating passages 22*e* including the air-fuel mixture generating sections will now be explained in detail.

Figure 8:
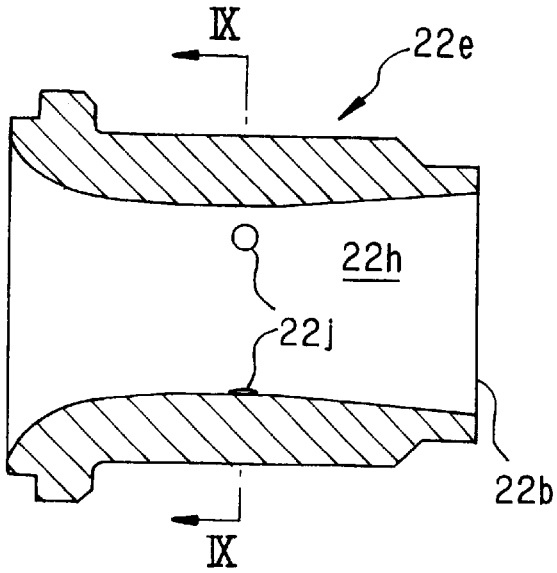
FIG. 8 is a sectional view of a throat portion of one of an air-fuel mixture generating passages formed in the mixer unit illustrated in FIG. 2.
Figure 9:
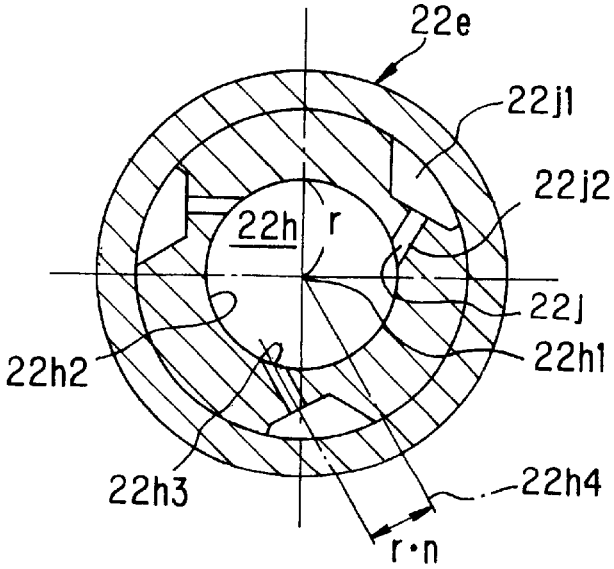
FIG. 9 is a sectional view taken along line IX—IX in FIG. 8.

FIG. 8 is a sectional view of the throat portion 22*h* of one of the air-fuel mixture generating passages 22*e*. FIG. 9 is a sectional view taken along line IX—IX in FIG. 8.

As illustrated, the throat portion 22*h* has a circular cross-section that gradually diminishes in diameter toward its central region where three of the aforesaid nozzles or jets 22*j* are formed at prescribed spacing which communicate with the fuel inlet 22*d* through the passage 22*k* formed radially at the central region. Each nozzle or jet 22*j* comprises a fuel channel 22*j*1 communicating with the passage 22*k* and an orifice or pore 22*j*2 extending along a straight line to connect with the fuel channel 22*j*1 and impart a direction to the injected or jetted fuel.

Defining the radius from the center 22*h*1 of the throat portion 22*h* to the wall surface 22*h*2 as r, each nozzle or jet 22*j* is formed so as to inject or jet premixed combustion fuel from a point 22*h*3 on a line offset n times the radius (diameter) r from, and lying parallel to, an arbitrary line 22*h*4 passing through the center. In other words, the fuel channel 22*j*1 is formed tangential to the throat portion 22*h* so as to lie parallel to the line 22*h*4. The value of n is smaller than 1, preferably 0.7 to 0.9.

This offsetting of the nozzle or jet 22*j* in the tangential direction (wall surface direction) relative to the center 22*h*1 of the throat portion 22*h* effectively promotes mixing of the inflowing air and fuel.

Specifically, in the case of the venturi mixers 22, since air and fuel are injected (jetted) at the throat portion 22*h* and the air and fuel are mixed utilizing the velocity gradient produced at the downstream deceleration section (22*e*1 explained later), the air and fuel can be mixed in a shorter time and more uniformly when the fuel is injected along the wall surface 22*h*2 of the throat portion than when it is injected to penetrate as far as the center region of the throat portion 22*h*. When fuel is injected too close to the wall surface 22*h*2, however, it stagnates in the region of small momentum near the wall surface (boundary layer) and does not disperse throughout the air, making it impossible to generate a homogeneous air-fuel mixture.

This embodiment is therefore structured to inject fuel along a line that lies parallel to an arbitrary line 22*h*4 passing through the center 22*h*1 and is slightly removed from the wall surface 22*h*2 (at r.n). Since the fuel therefore does not penetrate as far as the center region and does not stagnate at the boundary layer, mixing at the deceleration section is effectively promoted and a homogeneous or uniform air-fuel premixing can be generated in a short time. As n is set at a value between 0.7 and 0.9, fuel does not adhere to the wall surface 22*h*2 of the throat portion 22*h*.

This means that for the same time period (distance) a more homogeneous or uniform air-fuel premixing can be generated and that for the same combustion temperature (adiabatic flame temperature) the NOx emission concentration can be further reduced. Moreover, since an air-fuel premixing of a given uniformity can be mixed in a shorter time (distance), self-ignition can be more easily prevented to improve toughness against self-ignition.

The explanation of the air-fuel mixture generating passage 22*e* will now be continued with reference to FIG. 4. The diameter of the air-fuel mixture generating passage 22*e* increases gradually downstream of the throat portion 22*h* (increases 10 to 15 degrees in diameter relative to the center axis 22*a*3 of the mixer unit (coincident with the center axis 24*c*)) to form the deceleration section 22*e*1. Then, in the vicinity of the nozzles or jets 22*f* further downstream (from just before the nozzles or jets 22*f*), it decreases gradually or gently to form a throttle section 22*e*2.

In addition, the nozzle or jet 22*f* is shifted circumferentially about the center axis 22*a*3 relative to the air inlet 22*b*, whereby, as shown in FIG. 4, the portion of the air-fuel mixture generating passage 22*e* between the throttle section 22*e*2 and the nozzle or jet 22*f* is deflected in the circumferential direction by an angle θ (more exactly 60 to 70 degrees relative to the center axis 22*a*3).

Specifically, defining the air inlet of an arbitrary one of the inner ten venturi mixers as 22*b*1 and the nozzle or jet 22*f* thereof as 22*f*1, the two are, as shown in FIG. 3, shifted in the circumferential direction (anticlockwise in the drawing). Similarly, defining the air inlet of an arbitrary one of the outer ten venturi mixers as 22*b*2 and the nozzle or jet 22*f* thereof as 22*f*2, the two are, as shown in the same figure, shifted in the circumferential direction (anticlockwise in the drawing).

Owing to this structure, a swirler can be provided integrally with the venturi mixer 22 so as to promote combustion by imparting a swirling blow pattern to the injected air-fuel mixture, thereby enhancing flame holding performance and reducing CO emission concentration. Since stable premixed combustion therefore becomes possible even at a low adiabatic flame temperature, the range in which premixed combustion is possible can be expanded and NOx emission concentration further reduced.

As explained in the foregoing, in this embodiment the multiple venturi mixers 22 are arrayed on multiple circles of different diameter whose centers are on the center axis 24*c* of the combustion chamber 24 and utilize the vicinity of the nozzles or jets 22*f* as passages that communicate with the air-fuel mixture generating passages 22*e* and shrink in cross-sectional area while gradually deflecting in the tangential direction around the center axis 24*c*. As a result, the flow velocity of the air-fuel premixing in the vicinity of the nozzles or jets 22*f* can be increased by the throttle sections 22*e*2 to effectively prevent backfire that might otherwise be caused by invasion of the flame of the combustion chamber 24 into the venturi mixers 22. With this, it becomes possible to achieve premixed combustion without resulting in backfire and self-ignition, even at a high intake air temperature or at a high combustion temperature (adiabatic flame temperature) Further, owing to the gentle deflection of the passages, backfire and self-ignition can be effectively inhibited and strong swirling can be generated in the combustion chamber. As a result, stable combustion can be achieved and CO emission concentration reduced even when a lean premixed combustion state arises owing to accelerated combustion. Moreover, NOx emission concentration can also be reduced because combustion at a low combustion temperature (adiabatic flame temperature) becomes possible.

Thus, the expanded range over which premixed combustion is possible enables the gas-turbine engine 10 to achieve low-emission premixed combustion over a broad operating range (load range). The gas-turbine engine 10 is therefore able to realize enhanced low-emission performance.

As shown in the drawings, the air inlets 22*b* of the venturi mixers 22 are made circular in cross-section and the nozzles or jets 22*f* are made rectangular in cross-section. Moreover, based on a sectional area of the air inlets 22*b* of A, the cross-sectional area of the nozzles or jets 22*f* is defined as m times A (m: 1.0 to 1.1).

The venturi mixers 22 are fabricated by casting the main body 22*a*1 of the mixer unit 22*a* to include them and attaching the flange member 22*a*2 to the cast product. Although this type of multi-venturi mixer is ordinarily fabricated by joining individual venturi mixers into a bundle, the fabrication by casting lowers fabrication cost in volume production. The mixer unit 22*a* is fastened to a turbine casing 36 as shown in FIG. 1 by passing bolts (not shown) through bolt holes 22*a*4 drilled in the periphery of the mixer unit 22*a*.

Figure 10:
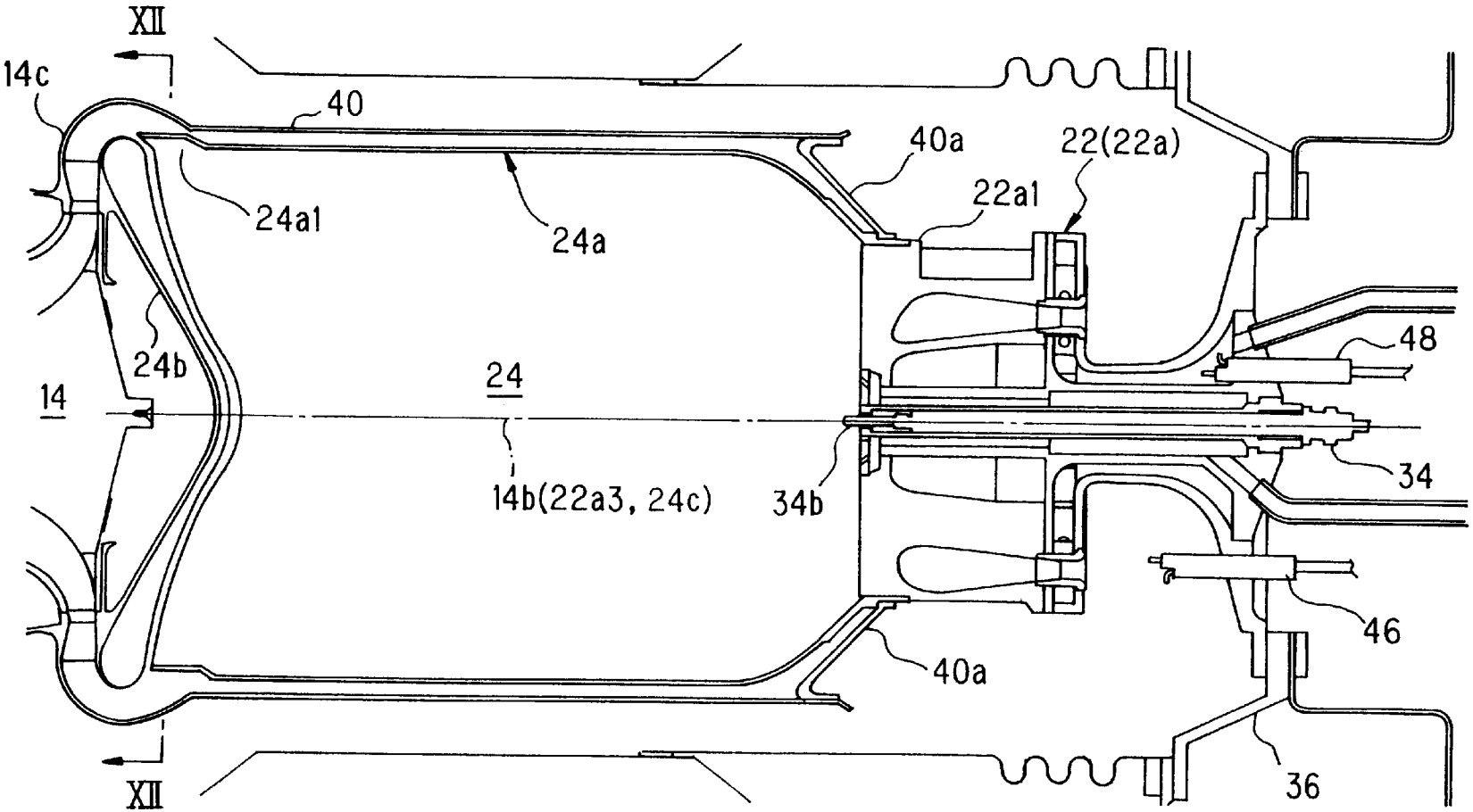
FIG. 10 is a partial sectional view of a portion in the vicinity of the combustion chamber illustrated in FIG. 1.
Figure 11:
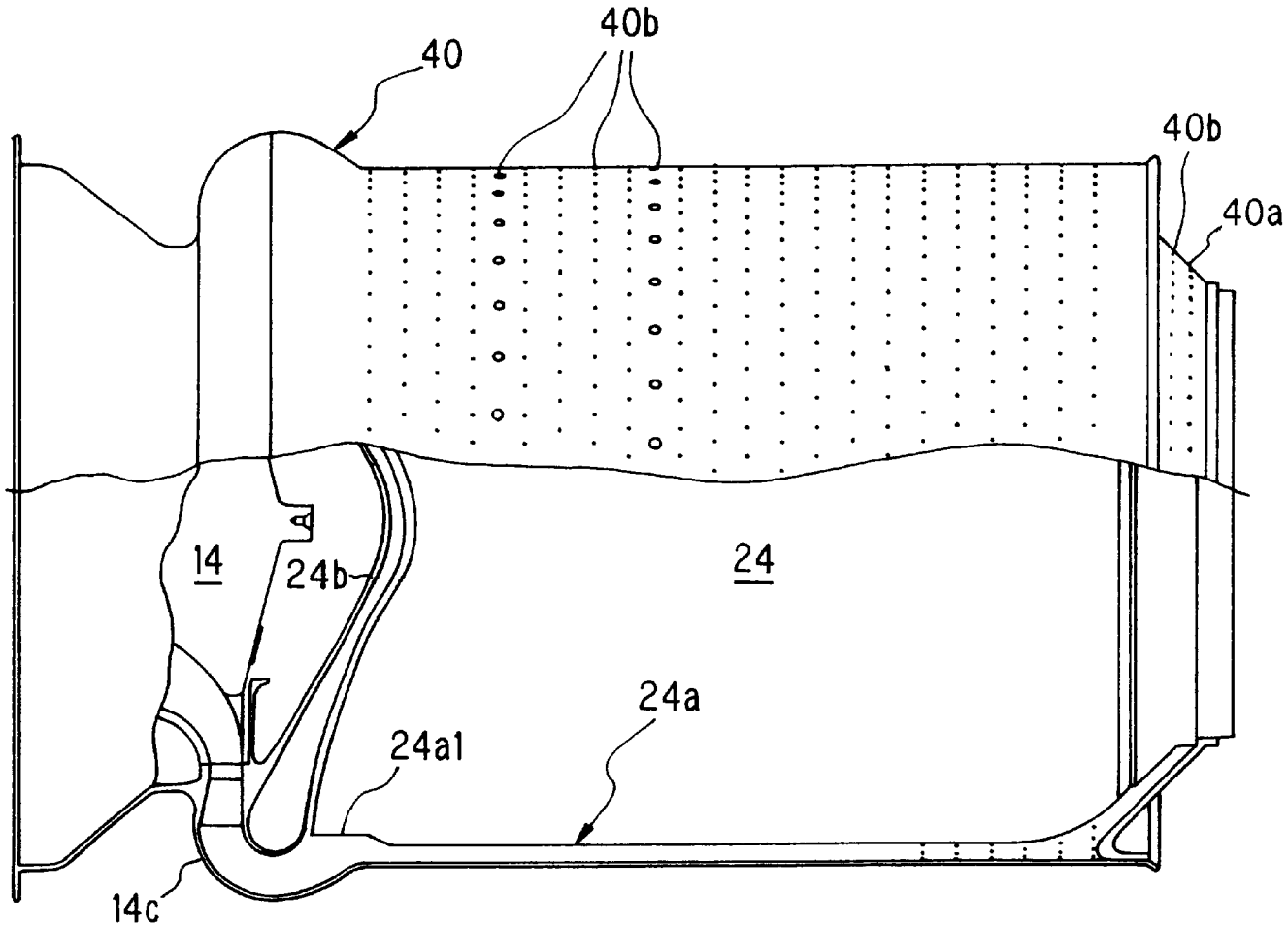
FIG. 11 is a partial sectional view of the same portion.

FIG. 10 is a partial sectional view of a portion in the vicinity of the combustion chamber 24. FIG. 11 is a partial sectional view of the same portion, and FIG. 12 is a sectional view taken along line X11—X11 in FIG. 10.

Figure 12:
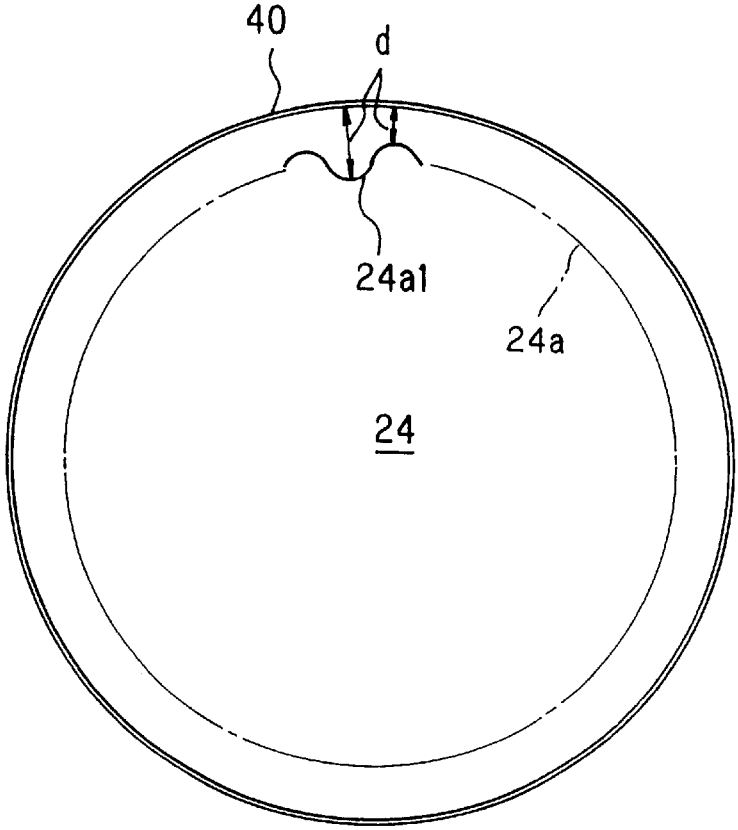
FIG. 12 is a sectional view taken along line X11—X11 in FIG. 10 and showing mixer forming portions provided near the end of a combustion chamber casing.

The explanation of the gas-turbine engine 10 will be continued with reference to FIGS. 10 to 12. The combustion chamber 24 is fastened to the mixer unit 22*a* through an airtight joint. The combustion chamber 24 is installed in a space enclosed by a casing (combustion chamber casing) 24*a* centered on the center axis 22*a*3 of the mixer unit 22*a* (coincident with the center axis 14*b* and the center axis 24*c*) and having a larger radius than the mixer unit 22*a* and by a side wall 24*b* provided with a convex sectional shape on the side facing the mixer unit 22*a* and structured to have a hollow interior.

A liner 40 is disposed outside the casing 24*a*. A conical dome 40*a* is fixed to the main body 22*a*1 of the mixer unit 22*a*. One end of the liner 40 is inserted into the dome 40*a* to be immobilized only in the radial direction (while remaining movable in the axial direction) and its other end constitutes the casing of a turbine nozzle 14*c* that serves as an inlet through which combusted gas produced in the combustion chamber 24 enters the turbine 14. As shown in FIG. 11, the liner 40 and the dome 40*a* are formed with numerous (multiple) holes 40*b*.

Figure 13:
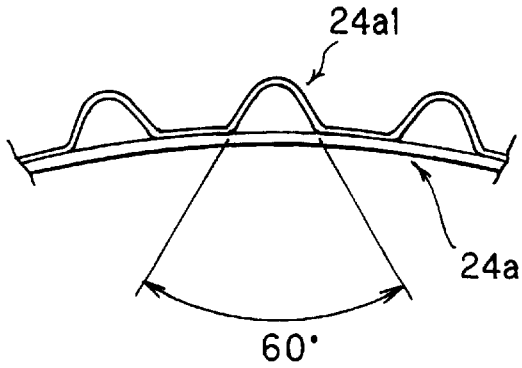
FIG. 13 is a partial sectional view showing a modification of the mixer forming portions illustrated in FIG. 12.

Mixer forming portions 24*a*1 are formed near the end of the casing 24*a* (adjacent to the side wall 24*b*). As shown in FIG. 12, the mixer forming portions 24*a*1 (only one shown) are given a wavy shape. They are formed so that the clearance d with respect to the liner 40 is small at the covex portions and large at the concave portions. The mixer forming portions 24*a*1 are formed over the entire periphery of the casing 24*a*. The mixer forming portions 24*a*1 may alternatively be in an inverted V-shape as shown in FIG. 13 in which the inverted V is configured to be 60 degrees, for example, as shown in the figure.

The operation of the gas-turbine engine 10 will now be explained with reference to FIG. 1.

Air sucked in through the air intake port 26 as indicated by arrow a and compressed by the compressor 12 (fresh air at, for example, 15° C.) flows into the air supply path 30 as indicated by arrow b.

On the other hand, since the combusted gas used to rotate the turbine 14 is still at a high temperature of around 700° C., it is sent to a heat exchanger 42, as indicated by arrow c, for heat exchange with the fresh air sucked in by the compressor 12. As a result, the air is raised to a temperature of, say, 600° C. Then, as indicated by arrow d, it passes through the air supply path 30 and is supplied to the venturi mixers 22 as explained earlier.

The air supplied to the venturi mixers 22 flows therein as indicated by the arrow to be mixed with gaseous fuel and the resulting air-fuel mixture is injected into the combustion chamber 24 where it is ignited by the ignition plug 34 to produce diffusive combustion or premixed combustion.

Although the air passing through the venturi mixers 22 has an elevated temperature of around 600° C., the temperature of the fuel in this embodiment is around 200° C. because, as best shown in FIG. 2, the ignition plug 34 is disposed on the center axis 22*a*3 of the main body 22*a*1 of the mixer unit 22*a* and the second fuel passage 22*m* for diffusive combustion is formed around the body 34*a* of the ignition plug 34. The ignition plug 34 is therefore thoroughly protected from the intake air temperature and its durability is enhanced.

Moreover, in this embodiment, the heating element 34*b* of the ignition plug 34 is located at the center of main body 22*a*1 of the mixer unit 22*a*, the 18 second nozzles or jets 22*n* for diffusive combustion are positioned to surround the heating element 34*b*, and the 20 nozzles or jets 22*f* for premixed combustion are arrayed to surround the second nozzles or jets 22*n*. That is, they are arrayed to operate together with the air-fuel mixture generating passages 22*e* so as to produce a swirl around the heating element 34*b* of the ignition plug 34. As a stagnant region is therefore present near the center axis 22*a*3 of the main body 22*a*1, a rich air-fuel mixture can be formed by injecting diffusive combustion fuel into this region where fuel dispersion is suppressed. In addition, the positioning of the heating element 34*b* of the ignition plug on the center axis 22*a*3 enhances ignition performance and flame holding performance.

Further, since this symmetrical arrangement of constituent members with respect to the center axis 22*a*3 (24*c*) equalizes the effects of heat-induced deformation (elongation), it enhances the durability of the venturi mixers 22. Fuel dispersion can be appropriately regulated by adjusting the flow pattern of the combustion air or by changing the diameter, number, angle etc of the second nozzles or jets 22*n*.

Thus, during premixed combustion the air-fuel mixture is swirled to promote and stabilize the combustion and expand the range over which premixed combustion is possible, thereby enabling enhanced low emission operation. During diffusive combustion, fuel dispersion is prevented and ignition performance and flame holding are enhanced, thereby enabling stable diffusive combustion even at low fuel flow rate and enhancing combustion stability and the like at the time of switching from premixed combustion to diffusive combustion.

As shown in FIG. 1, the so-produced combustion gas flows as indicated by arrow e to pass through the turbine nozzle 14*c* and rotate the turbine 14. The rotation of the turbine 14 is transmitted through the output shaft 14*a* to rotate the compressor 12 and drive the generator 20.

At this time, as indicated by arrow f, part of the air flowing through the air supply path 30 passes through the numerous holes 40*b* to be injected or jetted toward and collide with the wall of casing 24*a* of the combustion chamber 24 as cooling air.

In this embodiment, cooling air is injected or jetted from the numerous holes 40*b* so as to collide with the wall of the casing 24*a* because the combustion chamber 24 reaches a temperature of 1500° C. during combustion and the temperature of the wall of the casing 24*a* rises to 1000° C. unless cooled. This method boosts cooling efficiency by minimizing temperature increase of the cooling air near the casing 24*a*.

Although the maximum allowable temperature with regard to oxidation is ordinarily higher than that with regard to buckling, in the illustrated structure most of the load owing to the pressure difference arising between the air supply path 30 and the combustion chamber 24 is borne by the liner 40. (The pressure difference occurring between the outside of the casing 24*a* and the combustion chamber 24 is considerably low in comparison with the pressure difference occurring between the air supply path 30 and the combustion chamber 24.)

In this embodiment, however, the wall temperature of the liner 40 does not rise excessively because the casing 24*a* blocks the heat from the combustion chamber 24. Buckling resistance is therefore readily achieved. Since the load received by the casing 24*a* is small, moreover, the wall temperature can be raised to the allowable temperature with regard to oxidation so as to reduce CO emission concentration and enhance low emission performance.

Gas-turbine engines of this type ordinarily use the film cooling method for cooling the combustion chamber 24. In the film cooling method, the air utilized for cooling is introduced directly into the combustion chamber where it is used as air for combustion or dilution. In premixed combustion, air (fresh air) flowing into the combustion chamber 24 in the course of the combustion process destabilizes the combustion. The result is an increase in CO emission owing to incomplete combustion and flameout. Stable combustion (complete combustion) cannot be achieved and the NOx emission concentration increases unless the combustion temperature (adiabatic flame temperature) is high. This is caused by falling combustion gas temperature and/or loss of uniform spatial combustion temperature distribution.

In this embodiment, the perforated liner 40 (and dome 40*a*) enable cooling by impingement of injected or jetted air streams. As perforation of the casing 24*a* is therefore not required, entry of dilution air from this region is prevented. This makes it possible to achieve stable combustion and, in particular, to stabilize intrinsically unstable premixed combustion.

Thus, the air used to cool the casing 24*a* (the cooling air) is all mixed with combusted gas as dilution air (for controlling the combusted gas to a prescribed temperature). In other words, stable premixed combustion can be realized because the air is mixed with the combusted gas at the most downstream portion of the casing 24*a* after completion of the combustion reaction.

In addition, the mixer forming portions 24*a*l are formed near the end of the casing 24*a* so that the clearance d with respect to the liner 40 is small at the convex portions and large at the concave portions. Therefore, when the combusted gas indicated by the arrow e and the cooling air (dilution air) indicated by the arrow f merge at the turbine nozzle 14*c*, the large contact area established between them ensures good mixing. This also helps to stabilize the premixed combustion by reducing entry of cooling air into the combustion chamber 24.

The airtight joint established between the casing 24*a* and the main body 22*a*1 of the mixer unit 22*a* also helps to stabilize premixed combustion by preventing entry of air into the combustion chamber 24. Further, as pointed out earlier, stabler premixed combustion means a broader premixed combustion range and, in turn, improved low emission operation.

Moreover, the combusted gas and the dilution air (cooling air) are mixed (merged) as parallel streams and supplied to the turbine 14 through the turbine nozzle 14*c*. This further improves combustion stabilization because it prevents cooling air from flowing back into the combustion chamber 24.

As shown in FIG. 11, the liner 40 (and dome 40*a*) are formed with a group of relatively large diameter holes 40*b* while the remaining holes are all formed to the same smaller diameter. However, this arrangement can be changed with consideration to the temperature distribution of the combustion chamber 24 so as to establish a suitable wall temperature distribution. Effective cooling of the casing 24*a* can therefore be achieved without using the laminar cooling method.

As shown in FIG. 1, the combusted gas used for heat exchange is, as indicated by arrow g, discharged to the exterior of the gas-turbine engine 10 through an exhaust outlet 44. Reference numerals 46 and 48 appearing in FIGS. 1 and 10 each designates a combined pressure sensor and temperature sensor unit.

Thus, the embodiment is configured to have a gas-turbine engine combustor 16 having a plurality of venturi mixers 22, each connected to an air supply path 30 that passes air compressed by a compressor 12 and to a supply source of gaseous fuel, which mix the air and the gaseous fuel to produce an air-fuel mixture and supply the air-fuel mixture to a combustion chamber 24 for combustion such that produced combustion gas rotates a turbine 14 that outputs its rotation through an output shaft 14*a*, while driving the compressor by the rotation; including: an air inlet 22*b* formed in each of the venturi mixers and connecting to the air supply path 30; a fuel inlet 22*d* formed in each of the venturi mixers and connecting to the supply source of gaseous fuel; an air-fuel mixture generating passage 22*e*, formed in each of the venturi mixtures, which connects to the air inlet and the fuel inlet and merges with an air-fuel mixture generating section to produce the air-fuel mixture; and a nozzle or jet 22*f* which opens into the combustion chamber at an end of the air-fuel mixture generating passage; wherein the venturi mixers are arranged radially around a center axis 24*c* of the combustion chamber 24; the air-fuel mixture generating passage 22 formed in each of the venturi mixers is provided with a throttle section 22*e*2 of diminishing diameter; and the nozzle or jet 22*f* is shifted circumferentially about the center axis relative to the air inlet 22*b* such that the air-fuel mixture generating passage 22*e* is deflected in a circumferential direction between the throttle sections and the nozzle or jet.

Thus, a plurality of venturi mixers are arrayed radially around the center axis of the combustion chamber, the air-fuel mixture generating passages are formed in the vicinity of their nozzles or jets with throttle sections of diminishing diameter and the nozzles or jets are shifted circumferentially about the center axis relative to the air inlets, thereby establishing a structure in which the portion of the air-fuel mixture generating passages between the throttle sections and the nozzles or jets is deflected in the circumferential direction. In other words, multiple venturi mixers are arrayed on multiple circles of different diameter whose centers are on the center axis of the combustion chamber and utilize the vicinity of the nozzles or jets as passages that communicate with the air-fuel mixture generating passages and shrink in cross-sectional area while gradually deflecting in the tangential direction around the center axis. The flow velocity of the air-fuel premixing in the vicinity of the nozzles or jets can therefore be increased by the throttle sections to effectively prevent backfire that might otherwise be caused by invasion of the combustion chamber flame into the venturi mixers. As a result, premixed combustion can be achieved without occurrence of backfire and/or self-ignition even when the temperature of the air for combustion and the combustion temperature (adiabatic flame temperature) are high.

Owing to the gentle deflection of the passages, moreover, backfire and self-ignition can be effectively inhibited and strong swirling can be generated in the combustion chamber. As a result, stable combustion can be achieved and CO emission concentration reduced even when a lean premixed combustion state arises owing to accelerated combustion. Moreover, NOx emission concentration can also be reduced because combustion at a low combustion temperature (adiabatic flame temperature) becomes possible.

Thus, the expanded range over which premixed combustion is possible enables the gas-turbine engine to achieve low-emission premixed combustion over a broad operating range (load range). The gas-turbine engine is therefore able to realize enhanced low-emission performance.

In the gas-turbine engine combustor, the air-fuel mixture generating section includes; a throat portion 22*h* connecting to the air inlet 22*b* and having a circular cross-section of diminishing diameter; and a fuel passage 22*k* connecting to the fuel inlet 22*d* and merging with throat nozzles (jets) 22*j* formed in the throat portion to communicate with the air-fuel mixture generating passage, wherein, defining a radius from a center 22*h*1 of the throat portion to a wall surface 22*h*2 as r, each of the throat nozzles or jets 22*j* is formed so as to inject or jet the gaseous fuel from a point 22*h*3 on a line 22*h*4 offset n times the radius r from an arbitrary line passing through the center of the throat portion.

Thus, in the case of the venturi mixers, since air and fuel are injected (jetted) at the throat portions and the air and fuel are mixed utilizing the velocity gradient produced at the downstream deceleration sections, the air and fuel can be mixed in a shorter time and more uniformly when the fuel is injected along the wall surface of the throat portion than when it is injected to penetrate as far as the center region of the throat portion. When fuel is injected too close to the wall surface, however, it stagnates in the region of small momentum near the wall surface (boundary layer) and does not disperse throughout the air, making it impossible to generate a homogeneous or uniform air-fuel mixture.

Each air-fuel mixture generating section is therefore formed with a throat portion in communication with the air inlet and having a circular cross-section of diminishing diameter and a fuel passage in communication with the fuel inlet and merging with nozzles or jets formed in the throat portion to communicate with the air-fuel mixture generating passage. Each nozzle or jet is formed so as to inject gaseous fuel along a line that lies parallel to an arbitrary line passing through the center of the throat portion and is offset therefrom by n times the radius r measured from the center to the wall of the throat portion (n<1). In other words, fuel is injected along a line that lies parallel to a line passing through the center of the throat portion and is slightly removed from the wall surface. Since the fuel therefore does not penetrate as far as the center region and does not stagnate at the boundary layer, mixing at the deceleration section is effectively promoted and a homogeneous or uniform air-fuel premixing can be generated in a short time.

This means that for the same time period (distance) a more homogeneous or uniform air-fuel premixing can be generated and that for the same combustion temperature (adiabatic flame temperature) the NOx emission concentration can be further reduced. Moreover, since an air-fuel premixing of a given uniformity can be mixed in a shorter time (distance), self-ignition can be more easily prevented to improve toughness against selfignition.

More specifically, in the above, n is 0.7 to 0.9, and the air-fuel mixture generating passage 22*e* is provided with the throttle section 22*e*2 of diminishing diameter at a location close to the nozzles or jet 22*f* opened into the combustion chamber at the end of the air-fuel mixture generating passage. And, the output shaft 14*a* of the turbine is connected to an electric generator 20.

It should be noted in the above, although FIG. 9 shows an example in which the throat portion 22*h* of a venturi mixer 22 of the foregoing embodiment is provided with three nozzles or jets 22*j*, the number of nozzles or jets 22*j* can instead be two or four.

The entire disclosure of Japanese Patent Application No. 2001-258198 filed on Aug. 28, 2001, including specification, claims, drawings and summary, is incorporated herein in reference in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A gas-turbine engine combustor having a plurality of venturi mixers, each connected to an air supply path that passes air compressed by a compressor and to a supply source of gaseous fuel, which mix the air and the gaseous fuel to produce an air-fuel mixture and supply the air-fuel mixture to a combustion chamber for combustion such that produced combustion gas rotates a turbine that outputs its rotation, through an output shaft, while driving the compressor by the rotation; including:

an air inlet formed in each of the venturi mixers and connecting to the air supply path;

a fuel inlet formed in each of the venturi mixers and connecting to the supply source of gaseous fuel;

an air-fuel mixture generating passage, formed in each of the venturi mixes, which connects to the air inlet and the fuel inlet and merges with an air-fuel mixture generating section to produce the air-fuel mixture; and a nozzle which opens into the combustion chamber at an end of the air-fuel mixture generating passage;

wherein:

the venturi mixers are arranged radially around a center axis of the combustion chamber;

the air-fuel mixture generating passage formed in each of the venturi mixers is provided with a throttle section of diminishing diameter; and the nozzle is shifted circumferentially about the center axis relative to the air inlet such that the air-fuel mixture generating passage is deflected in a circumferential direction between the throttle sections and the nozzle.

2. A gas-turbine engine combustor according to claim 1, wherein the air-fuel mixture generating section includes;

a throat portion connecting to the air inlet and having a circular cross-section of diminishing diameter; and a fuel passage connecting to the fuel inlet and merging with throat nozzles formed in the throat portion to communicate with the air-fuel mixture generating passage.

3. A gas-turbine engine combustor according to claim 2, wherein, defining a radius from a center of the throat portion to a wall surface as r, each of the throat jets is formed so as to inject the gaseous fuel from a point on a line offset n times the radius r from an arbitrary line passing through the center of the throat portion.

4. A gas-turbine engine combustor according to claim 3, wherein n is 0.7 to 0.9.

5. A gas-turbine engine combustor according to claim 1, wherein the air-fuel mixture generating passage is provided with the throttle section of diminishing diameter at a location close to the nozzle opened into the combustion chamber at the end of the air-fuel mixture generating passage.

6. A gas-turbine engine according to claim 1, wherein the output shaft of the turbine is connected to an electric generator.

* * * * *